US005922650A

United States Patent [19]

Ye

[11] Patent Number: 5,922,650

[45] Date of Patent: Jul. 13, 1999

[54] METHOD AND STRUCTURE FOR HIGH POWER HTS TRANSMISSION LINES USING STRIPS SEPARATED BY A GAP

[75] Inventor: Shen Ye, Cambridge, Canada

[73] Assignee: Com Dev Ltd., Cambridge, Canada

[21] Appl. No.: 08/595,864

[22] Filed: Feb. 6, 1996

[30] Foreign Application Priority Data

May 1, 1995 [CA] Canada ..... 2148341

[51] Int. Cl.[6] ..... H01B 12/02; H01P 3/00

[52] U.S. Cl. ..... 505/210; 505/238; 505/701; 505/703; 505/866; 333/204; 333/995; 428/210; 428/702; 428/930

[58] Field of Search ..... 333/140, 161, 333/204, 238, 246, 995, 1, 128; 505/210, 220, 238, 701, 703, 866; 428/209, 210, 689, 702, 930, 141, 167

[56] References Cited

U.S. PATENT DOCUMENTS

| | | | |
|---|---|---|---|
| 4,441,088 | 4/1984 | Anderson | 333/1 |
| 5,012,319 | 4/1991 | Dykaar et al. | 257/662 |
| 5,219,827 | 6/1993 | Higaki et al. | 505/210 |
| 5,404,119 | 4/1995 | Kim | 333/204 |
| 5,406,233 | 4/1995 | Shih et al. | 333/161 |
| 5,426,399 | 6/1995 | Matsubayashi et al. | 333/1 |
| 5,496,795 | 3/1996 | Das | 505/210 |
| 5,616,538 | 4/1997 | Hey-Shipton et al. | 505/210 |
| 5,703,020 | 12/1997 | Das | 505/210 |

OTHER PUBLICATIONS

Steven T. Ruggiero et al., *Superconducting Devices,* Academic Press, Inc. 1990, pp. 258–243, 1990.

*Primary Examiner*—Marie Yamnitzky
*Attorney, Agent, or Firm*—Daryl W. Schnurr

[57] ABSTRACT

Microstrip/stripline transmission lines have a plurality of strips on a substrate where strips are separated by a gap. This arrangement results in a reduced maximum current density compared to previous transmission lines with the same power handling capability. The strips can have the same width or different widths. The gaps can have the same width or different widths. The transmission lines can be used in filters and resonators and can be made of high temperature superconductive materials.

17 Claims, 9 Drawing Sheets

PRIOR ART

METHOD AND STRUCTURE FOR HIGH POWER HTS TRANSMISSION LINES USING STRIPS SEPARATED BY A GAP

BACKGROUND OF THE INVENTION

1. Field of the Invention

This invention relates to microstrip/stripline transmission lines and microstrip/stripline filters and to a method of construction thereof. More particularly, this invention relates to filters and transmission lines having at least a portion thereof divided into elongated strips.

2. Description of the Prior Art

Microstrip or stripline filters are an important part of microwave circuit designs. Generally, these filters are used in low Q and low power applications because firstly, the conventional conducting materials, for example, gold, silver, copper, etc. are relatively lossy and, secondly, the cross-section current distribution of a microstrip/stripline filter is highly non-uniform. High Q can be achieved for narrow band microstrip/stripline filters when they are constructed of high temperature superconductive (HTS) materials. HTS materials improve the power handling capability of these filters as they have a low loss and high current capacity. It is known to provide filters with improved power handling capability by using low impedance lines and dual-mode patch resonators. Microwave filters using dual-mode patch resonator structures can handle more power than single mode line resonator filters because of the patch size. However, there are limitations on the layout and therefore the size of the filter.

In a paper by Liang, et al., entitled "High-Power HTS Microstrip Filters for Wireless Communication" and published in IEEE MTT-S International Microwave Symposium, High Power Superconducting Microwave Technology Workshop Notes, May, 1994, several narrow band filters are described for high power handling. These filters use low impedance line (i.e. wider resonator line width) to reduce the current density inside the resonator. For a five-pole 0.6% filter with two GHz center frequency, 30 dBm input power at 77K and 41 dBm input power at 12K have been attained. However, increasing the line width of a resonator can reduce the average cross-section current density, but it cannot effectively reduce maximum current density since the cross-section current density distribution of a microstrip or stripline is highly non-uniform.

It is known that the current concentrates more towards the outer surface of a round transmission line when frequency becomes higher. The effective current carrying area of the line cross-section is limited to the outer surface. It is known that microstrip/stripline transmission lines or filters have a non-uniform current distribution and that significantly higher current density exists near the edge of the line in what can be referred to as the "edge effect".

SUMMARY OF THE INVENTION

In this specification, microstrip transmission lines, resonators and filters are considered to be equivalent to stripline transmission lines, resonators and filters. Any transmission line, resonator or filter that can be made of microstrip can also be made of stripline.

It is an object of the present invention to provide a microstrip/stripline transmission line where the edge current is effectively reduced, thereby enabling the transmission line to have greater power handling capability. The transmission line can be a resonator and can be included in any microwave circuit including a filter.

A microwave transmission line for carrying current at microwave frequencies comprises several elongated strips selected from the group consisting of microstrip and stripline. Each strip has an input end and an output end. The strips are arranged on a substrate with a gap between at least two adjacent strips. Preferably, there is a gap between each of the adjacent strips.

A method of constructing a microwave transmission line having several elongated strips selected from the group consisting of microstrip and stripline mounted on a substrate, each strip having an input end and an output end, said strips being arranged on a substrate with a gap between adjacent strips, there being two outside strips, said method comprising choosing the number, width and shape of strips as well as the gap size between strips in order to achieve an acceptable level of current density along outside edges of the two outside strips.

DESCRIPTION OF A PREFERRED EMBODIMENT

Figure 1:
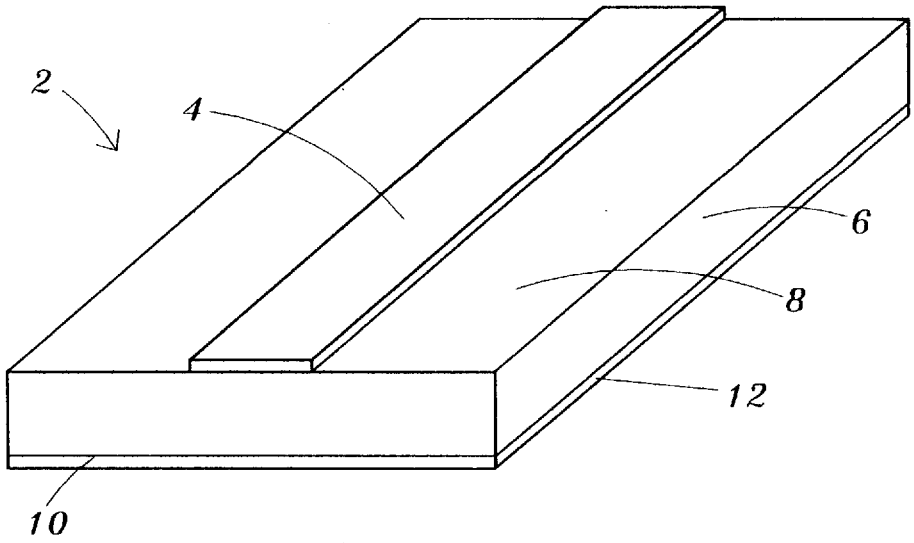
Figure 1 PRIOR ART
FIG. 1 is a perspective view of a prior art microstrip transmission line.

In FIG. 1, a prior art microstrip transmission line 2 has an elongated piece 4 of microstrip arranged on a substrate 6 of dielectric material. The substrate 6 has a top 8 and a bottom 10 with a conducting layer 12 covering the bottom 10 as a ground plane.

Figure 2:
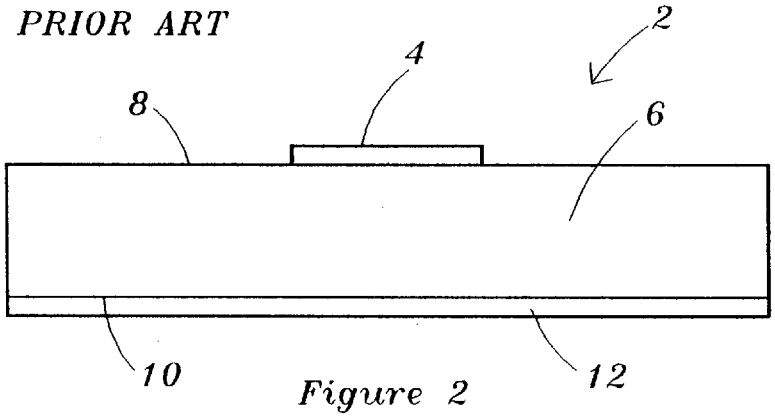
Figure 2 PRIOR ART
FIG. 2 is an end view of the prior art transmission line of FIG. 1.
Figure 3:
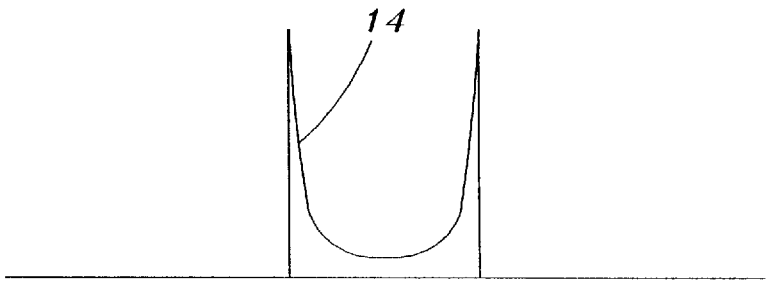
FIG. 3 is a schematic illustration of the current density distribution over a cross-section of the microstrip line.

FIG. 2 is an end view of the prior art microstrip transmission line of FIG. 1 and FIG. 3 is a graph that schematically illustrates a current density 14 across the width of the microstrip line 4. It can be seen from FIG. 3 that the current density near the outside edges of the microstrip 4 is considerably higher than the current density elsewhere on the microstrip. Stripline structure can readily be substituted for the microstrip structure in FIGS. 1 and 2.

Figure 4:
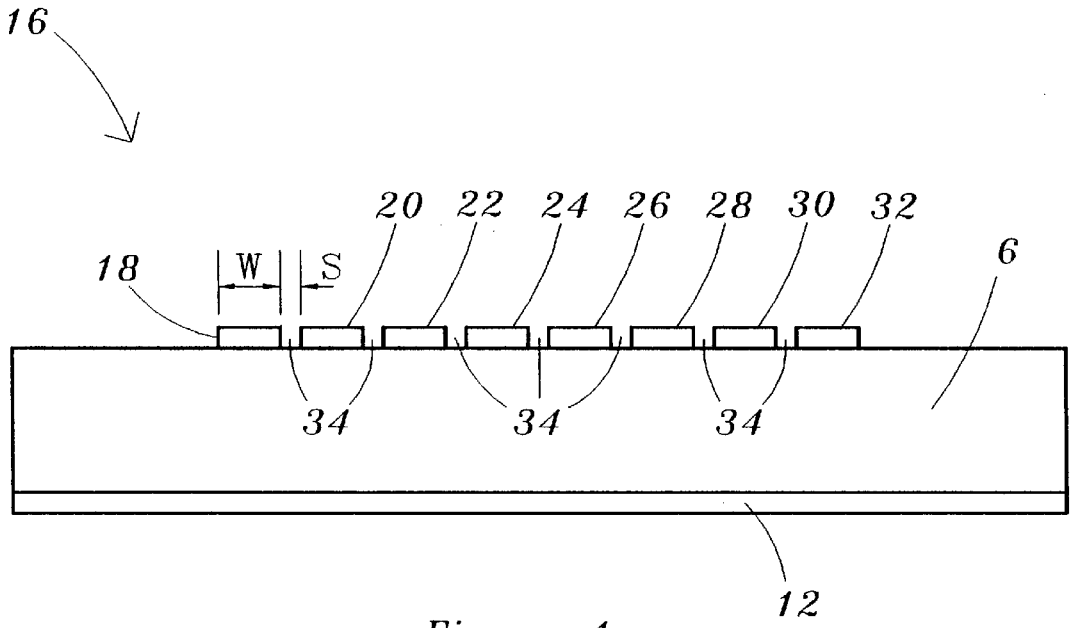
FIG. 4 is an end view of a microstrip transmission line where the line has several elongated strips and adjacent strips are separated by a gap.
Figure 5:
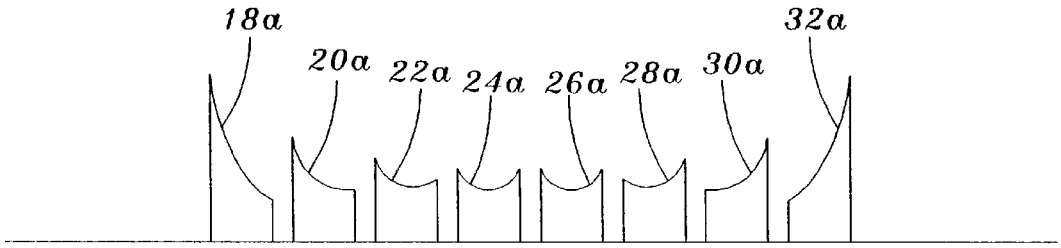
FIG. 5 is a schematic illustration of the current density distribution across a cross-section of the microstrip transmission line shown in FIG. 4.

In FIG. 4, there is shown an end view of a microstrip transmission line 16 for carrying current at microwave frequencies. The transmission line 16 has several elongated strips 18, 20, 22, 24, 26, 28, 30, 32 with a gap 34 located between adjacent strips. Each strip has a width W and each gap has a size S. The strips are arranged on a substrate 6 with a ground plane 12, these components being identical to those of the prior art transmission line 2. The strips 18, 20, 22, 24, 26, 28, 30, 32 have a rectangular shape with side edges that are parallel to one another. Each strip has the same size W and the gaps 34 between the strips have an identical size S. The width W and/or the gap size S of each of the strips could vary across the transmission line. The number of strips could also vary from that shown in FIG. 4. Since the gaps 34 are non-conducting, the current distributes between the strips as schematically shown in the graph of FIG. 5 where the current density 18*a*, 20*a*, 22*a*, 24*a*, 26*a*, 28*a*, 30*a*, 32*a* corresponds to the current density of the strips 18, 20, 22, 24, 26, 28, 30, 32 respectively. It can be seen that the current density along the outer edges of the two outer strips 18, 32 is much higher than the current density on the remaining strips but is much less than the maximum current density shown for the prior art transmission line in FIG. 3. Further, it can be seen from FIG. 5 that the current density of the strips 24, 26 at centre of the transmission line is higher at the outer edges thereof than in the remainder of said strips 24, 26. Further, the current density on the strips 18, 20, 22, 28, 30, 32 is highest on an outer edge of said strips 18, 20, 22, 28, 30, 32. Still further, it can be seen that the current density is distributed more evenly in FIG. 5 than the current density for the prior art transmission line shown in FIG. 3.

The number of strips for a particular transmission line is determined by the selection of the width of each strip and the gap size between adjacent strips. The cross-section current distribution can be fine tuned with proper selection of W and S for the strips and gap size across the line.

Figure 6:
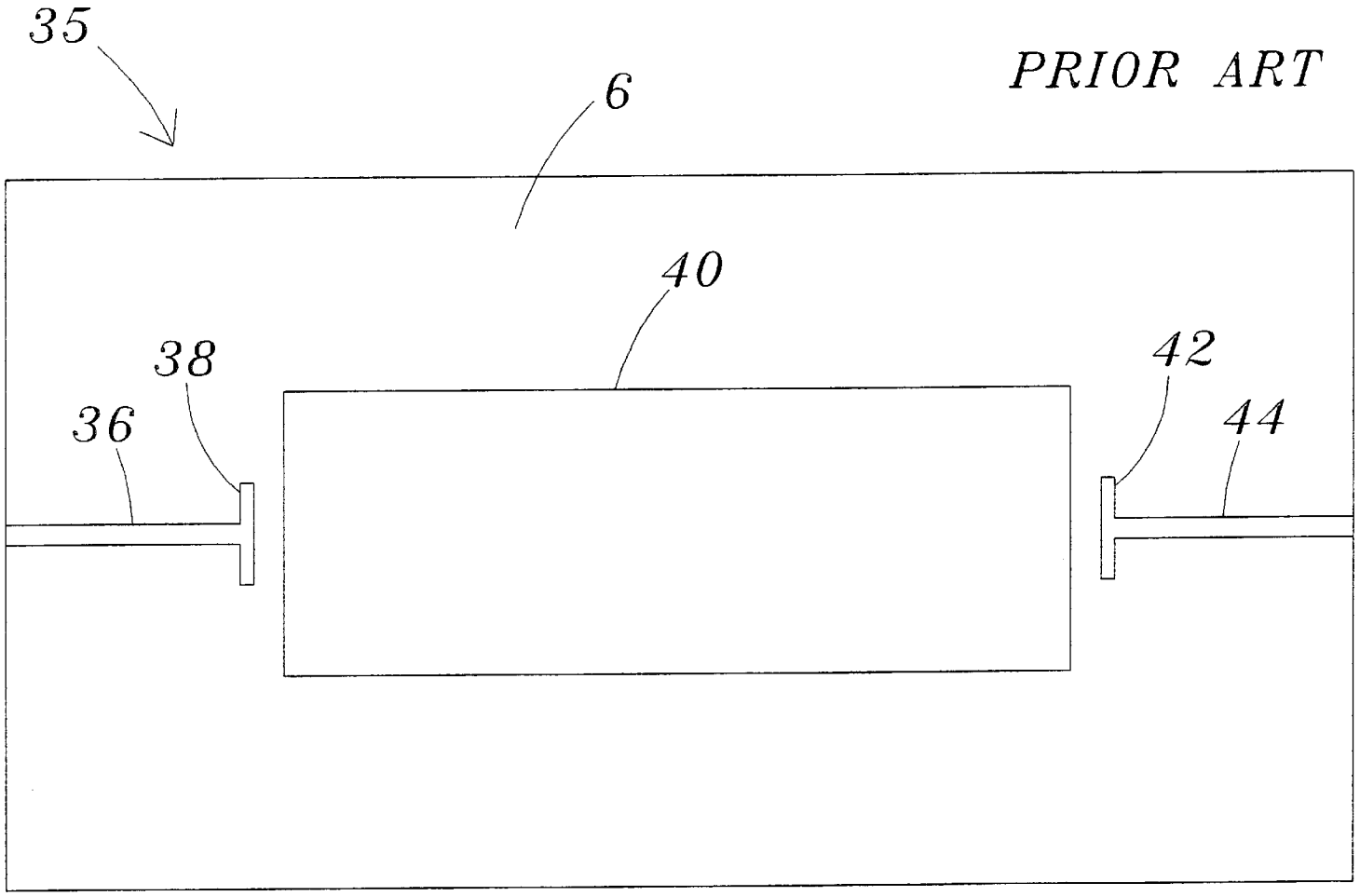
FIG. 6 is a top view of a prior art microwave microstrip circuit having a rectangular resonator therein.

In FIG. 6, there is shown a schematic top view of a prior art single half wavelength microstrip resonator circuit 35 on a substrate 6. The circuit has a ground plane beneath the substrate 6 (as in FIG. 1), which is not shown in FIG. 6. The circuit 35 has an input line 36, a coupling line 38, a solid microstrip resonator 40, a coupling line 42 and an output line 44.

Figure 7:
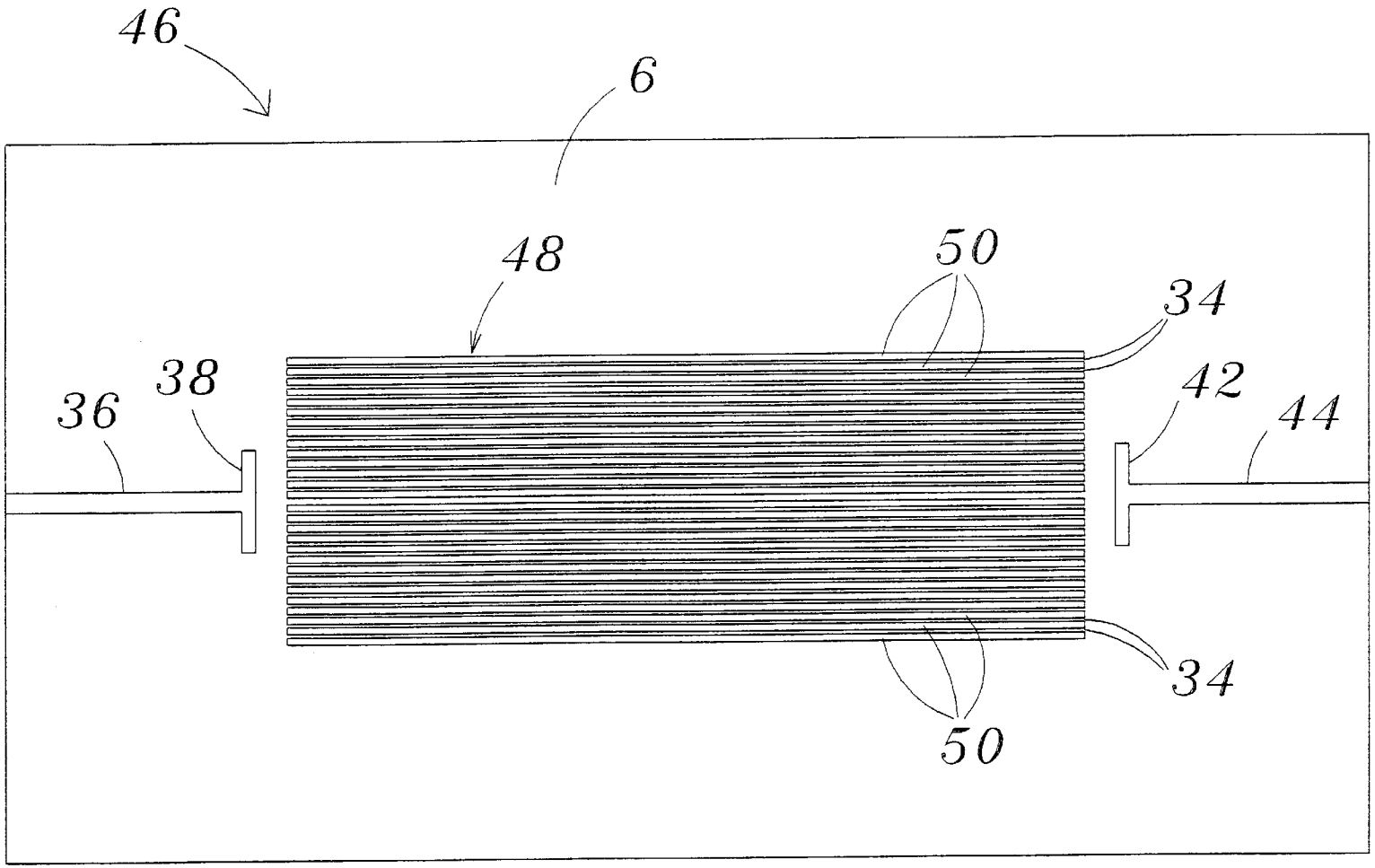
FIG. 7 is a top view of a microwave circuit similar to that of FIG. 6 except that the resonator is divided into elongated strips separated by a gap.

In FIG. 7, a microstrip resonator circuit 46 is shown. The same reference numerals are used in FIG. 7 for those components that are virtually identical to those of FIG. 6. The circuits 46 and 35 are identical except for the resonator. The circuit 46 has a resonator 48 that is made up of several elongated strips 50. The strips 50 are rectangular in shape with parallel side edges and a gap 34 between adjacent strips. The circuit 46 also has a ground plane (not shown).

Figure 8:
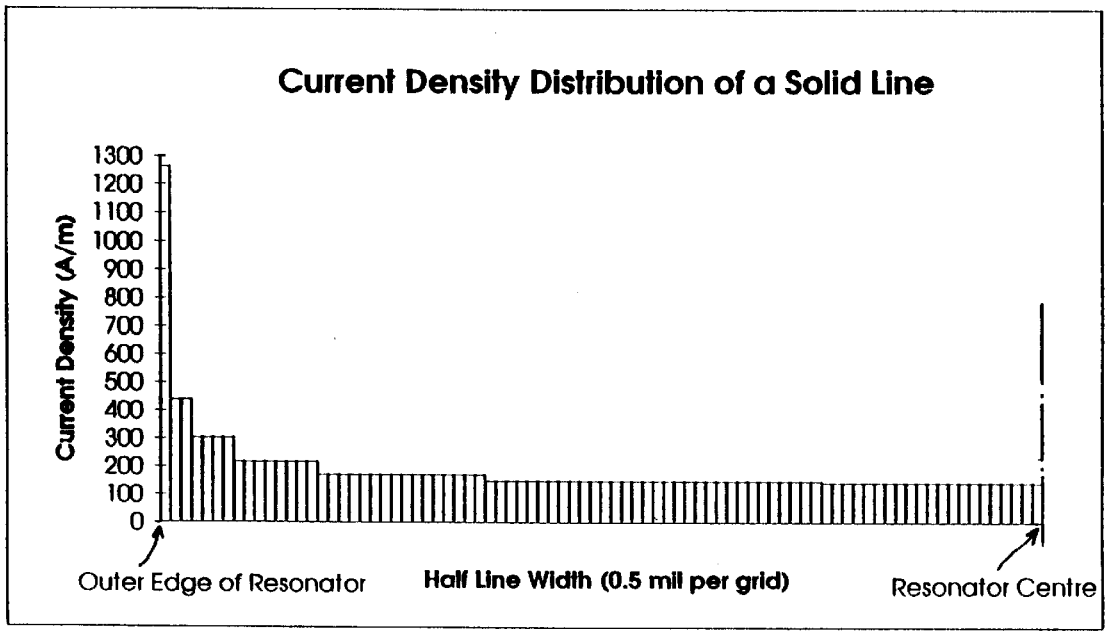
FIG. 8 is a graph showing the current density distribution of half a cross-sectional line width of the prior art transmission lines shown in FIG. 6.

In FIG. 8, a graph of the current density distribution across one-half of a cross-section through a -center of the resonator 40 is shown. When full wave electromagnetic simulation is applied using Em software (Em User's Manual, Sonnet Software Inc., 135 Old Cove Road, Suite 203, Liverpool, N.Y., 13090-3774), a maximum current density of 1262 A/m is indicated for an outside edge of the resonator 40. While the current density distribution is only shown for half of the resonator, the current density distribution of the other half of the resonator would be virtually identical to the half that is shown with the current density along the two outer edges being the maximum current density. The simulation was done assuming that the line thickness is infinitely thin and the cell size (i.e. the resolution) is 1.0 mil by 0.5 mil, with a resonator size of 234 mil by 84 mil.

Figure 9:
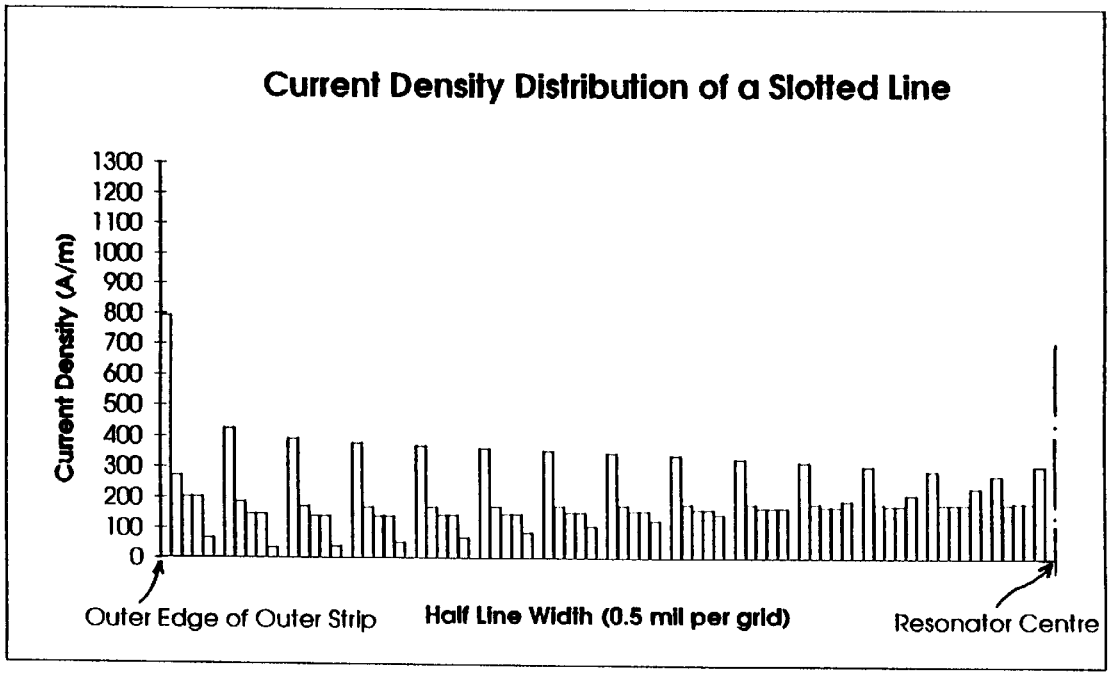
FIG. 9 is a graph showing the current density distribution of half the cross-sectional width of the resonator that has been divided into strips as shown in FIG. 7.

In FIG. 9, there is shown a graph of the current density distribution for one-half of the resonator 48 of the resonator circuit 46. Using the same cell size and resonator size, the current density of the outer edge of the outermost strip is 793 A/m, a 37% reduction of the maximum current density for the resonator 40 of the circuit 34.

Figure 10:
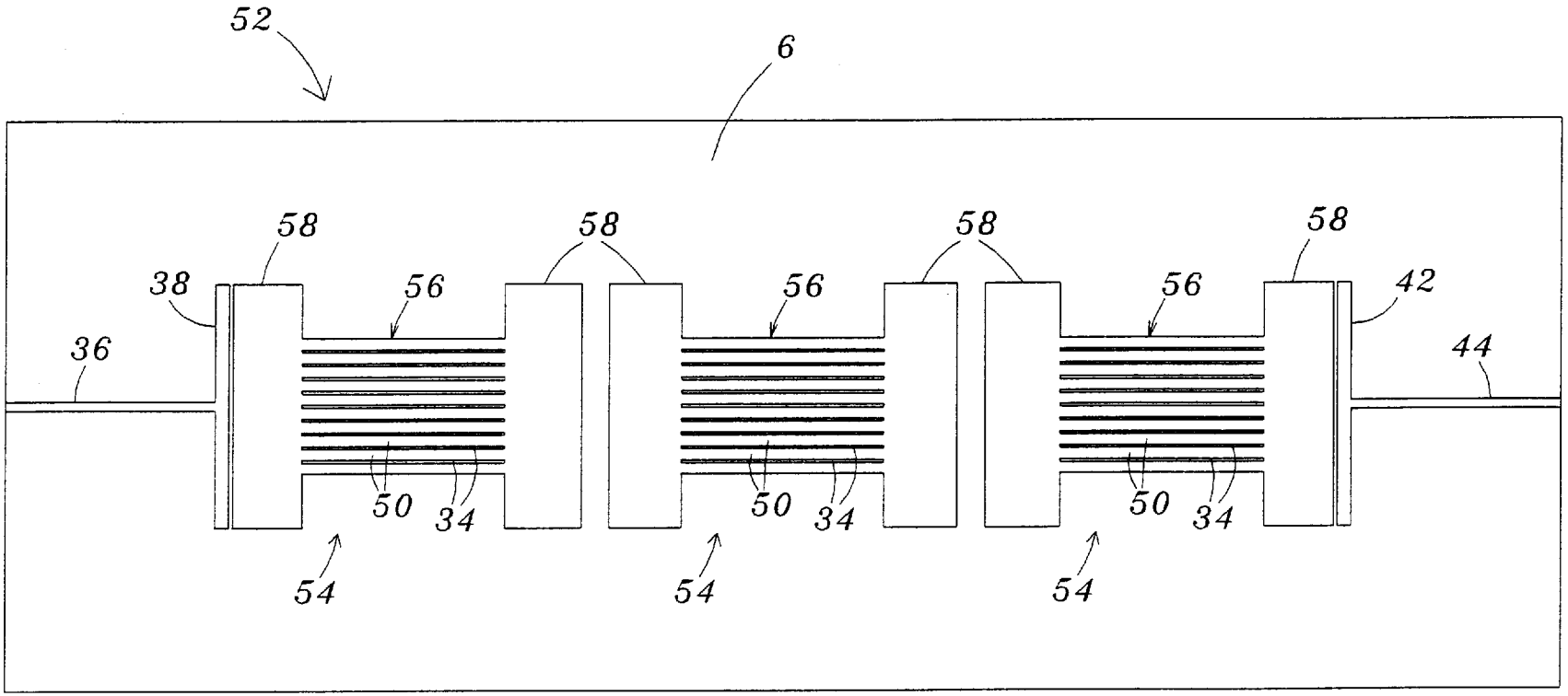
FIG. 10 is a top view of a three-pole microstrip filter where a middle section of the microstrip lines of each resonator have been divided into strips, each separated by a gap.

In FIG. 10, there is shown a top view of a three-pole microstrip pseudo-lumped element filter 52 for high power applications. The filter has an input line 36 and a coupling line 38. The filter 52 has an output coupling line 42 and an output line 44. Between the coupling lines 38, 42 are three lumped elements 54 which are spaced apart from one another. Each lumped element 54 has a central section 56 that emulates inductors and two end sections 58 that emulate capacitors. The center sections 56 are divided into several strips 50 separated by gaps 34. The filter 52 was constructed using high temperature superconductive material.

Figure 11:
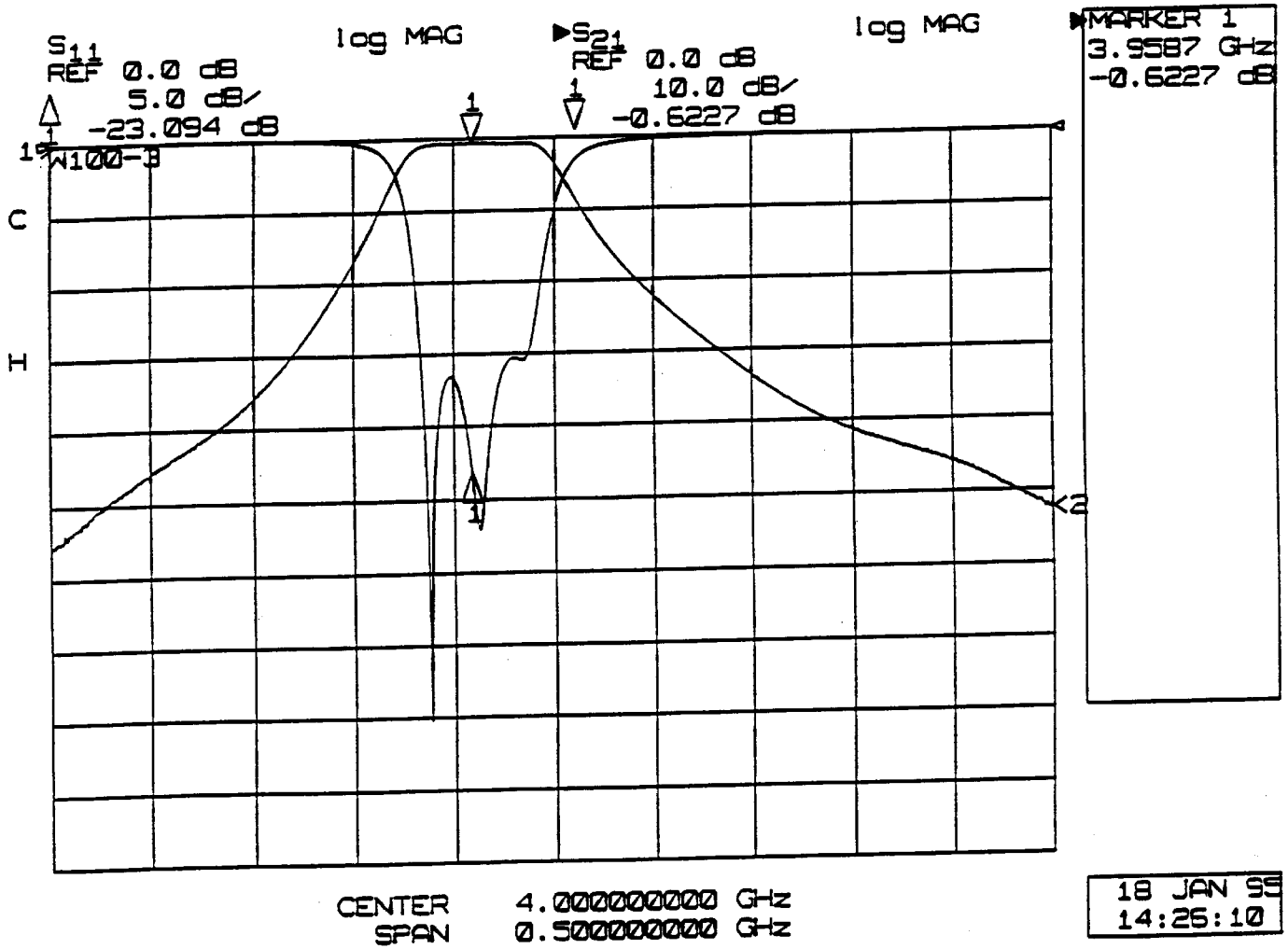
FIG. 11 is the measured electrical response of the three-pole filter shown in FIG. 10.

FIG. 11 is a graph showing the measured electrical responses, being the insertion loss and return loss at 77K.

Figure 12:
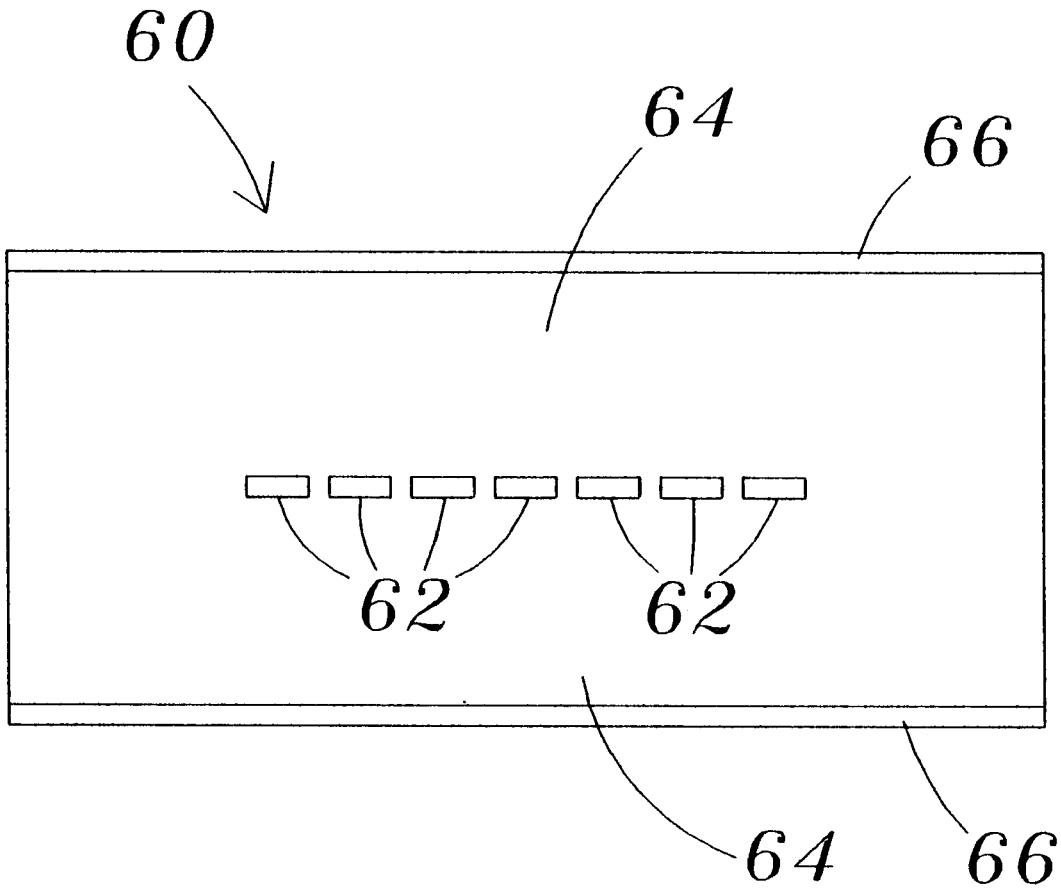
FIG. 12 is a cross sectional view of a stripline transmission line having several elongated strips.

In FIG. 12, there is shown a stripline transmission line 60. The stripline 60 has a plurality of strips 62 sandwiched between two substrates 64 and two ground planes 66. It is well known that stripline is equivalent to microstrip and that stripline has two substrates and two ground planes in a "sandwich" arrangement and microstrip has only one ground plane.

Figure 13:
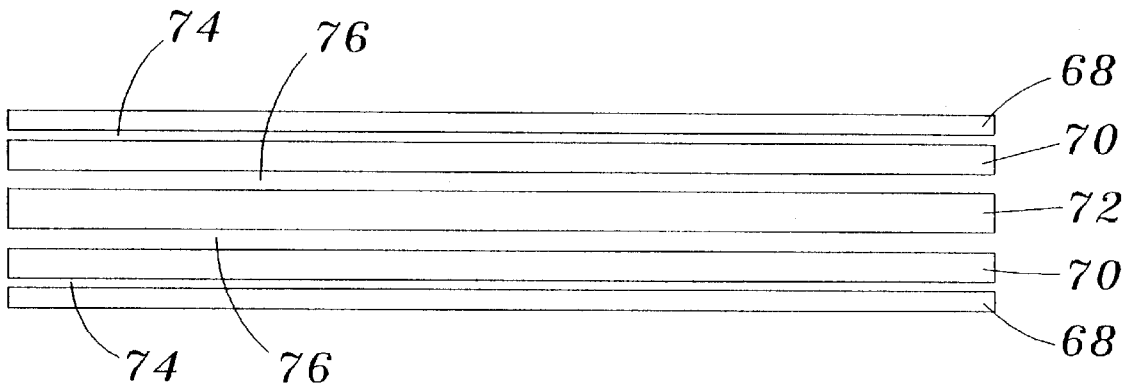
FIG. 13 is a schematic top view of strips for a microstrip/stripline transmission line having different widths and different gap sizes.

In FIG. 13, there is shown a schematic top view of strips 68, 70, 72 of a microstrip/stripline transmission line (not shown). The strips 68 have an identical width and are narrower than the strips 70. The strips 70 have an identical width and are narrower than the single strip 72. Gaps 74 between strips 68, 70 are identical to one another and are narrower than gaps 76 located between strips 70, 72.

Figure 14:
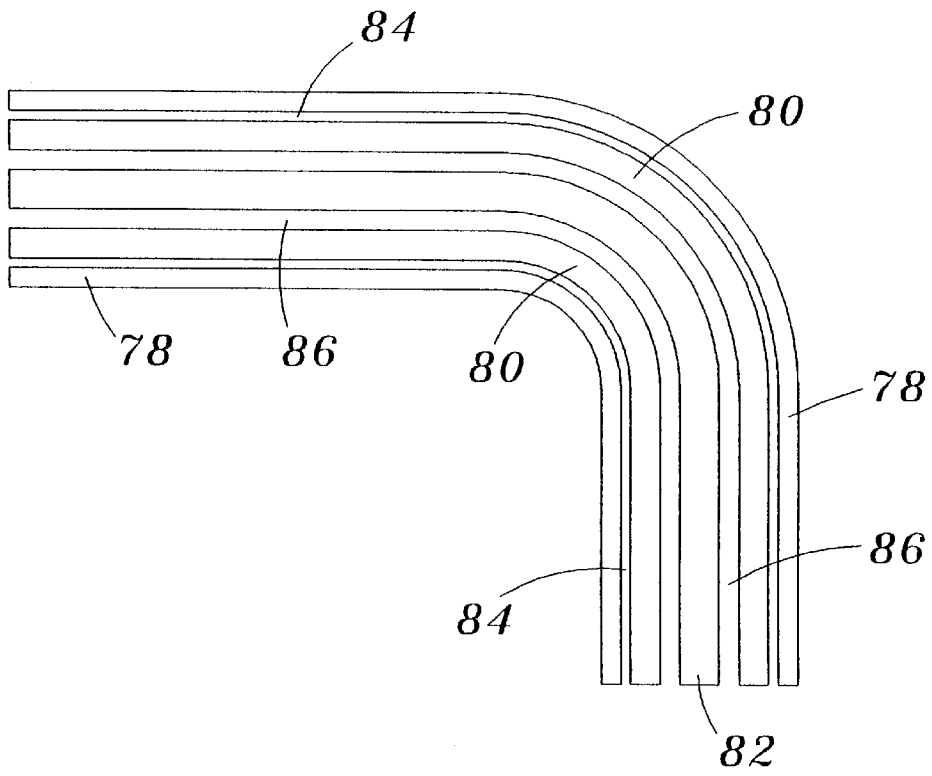
FIG. 14 is a schematic top view of strips of a microstrip/stripline transmission line where the strips are curved.

In FIG. 14, there is shown a schematic top view of strips 78, 80, 82 of a microstrip/stripline transmission line (not shown). The strips 78, 80, 82 curve smoothly through a 90° curve. Strips 78 are identical to one another and are narrower than strips 80, which in turn are narrower than the center strip 82. Similarly, gaps 84 between strips 78, 80 are narrower than gaps 86 between strips 80, 82.

The microstrip/stripline transmission line of the present invention can be used in any microstrip/stripline circuit either for connecting, or as a resonator, or part of a resonator to improve the power handling capability of that particular transmission line. For example, the invention can be used in a filter using multiples of quarter wavelength transmission line as resonators, in a stepped impedance filter, a lumped element filter where the inductors are approximated by a piece of transmission line, in comb-line and in hairpin-line filters.

While a preferred shape of the strips is rectangular, other elongated shapes will be suitable. For example, in FIG. 14, the strips are curved. As another example, the strips could be S-shaped and the edges of the strips could be parallel or non-parallel. The width of the strips can vary in size as can the gap size across different strips.

What I claim as my invention is:

1. A microwave transmission line for carrying current at microwave frequencies comprising an input and an output, several elongated strips selected from the group consisting of microstrip and stripline, each strip having an input end and an output end extending between said input and output of said transmission line, said transmission line having two outer edges, one outer edge along each side of said transmission line, said strips being located in an arrangement on a substrate with a gap between at least two adjacent strips to carry said current from said input to said output, said arrangement of strips providing means to reduce current density along said outer edges of said transmission line.

2. A transmission line as claimed in claim 1 wherein there is a gap between each of the adjacent strips.

3. A transmission line as claimed in claim 2 wherein each strip has two side edges and the side edges of the strips are substantially parallel to one another.

4. A transmission line as claimed in claim 3 wherein the strips have a width that is identical to one another.

5. A transmission line as claimed in claim 4 wherein a size of the gap between adjacent strips is identical.

6. A transmission line as claimed in claim 5 wherein each strip has a substantially rectangular shape.

7. A transmission line as claimed in claim 6 wherein the substrate is made of dielectric material.

8. A transmission line as claimed in claim 7 wherein the strips are of stripline and are printed on a substrate with a second substrate on top of the stripline and a ground plane on each of a top and bottom surface.

9. A transmission line as claimed in any one of claims 1, 2 or 3 wherein the said strips are microstrip and are formed on a substrate having a top on which the strips are located and a bottom on which a ground plane is located.

10. A transmission line as claimed in any one of claims 1, 2 or 3 wherein the strips are made of high temperature superconductive material.

11. A transmission line as claimed in any one of claims 1, 2 or 3 wherein the line is a resonator in a filter of a microwave circuit.

12. A transmission line as claimed in any one of claims 1, 2 or 3 wherein at least two strips have a width that is different from other strips.

13. A transmission line as claimed in any one of claims 1, 2 or 3 wherein a size of the gap between one pair of strips is different from a size of the gap between another pair of strips.

14. A transmission line as claimed in any one of claims 1, 2 or 3 wherein a gap size varies and a width of the strips varies.

15. A transmission line as claimed in any one of claims 1, 2 or 3 wherein the strips are shaped in the form of a smooth curve.

16. A method of constructing a microwave transmission line to carry current at microwave frequencies having an input and output with several elongated adjacent strips selected from the group consisting of microstrip and stripline mounted on a substrate, each strip having an input end and an output end extending between said input and output of said transmission line, said transmission line having two outer edges, said strips being located in an arrangement on a substrate with a gap between adjacent strips to carry said current from said input to said output, there being two outside strips each providing an outer edge of said transmission line, said arrangement of strips providing means to reduce current density along said outer edges, said method comprising choosing the number, width and shape of strips as well as the gap size between these strips in order to achieve an acceptable level of current density along outside edges of the two outside strips when said current is carried from said input to said output.

17. A method as claimed in claim 16 wherein the transmission line is made of high temperature superconductive materials and the method includes the step of choosing the acceptable level of current density along the outside edges of the two outside strips to be less than the critical current limit of the transmission line.

* * * * *